United States Patent [19]

Brubaker

[11] Patent Number: 4,857,925

[45] Date of Patent: Aug. 15, 1989

[54] ROUTE INDICATING SIGNALLING SYSTEMS FOR TRANSPORT VEHICLES

[76] Inventor: Charles E. Brubaker, 2601 Robinson Dr. #35, Waco, Tex. 76706

[21] Appl. No.: 142,476

[22] Filed: Jan. 11, 1988

[51] Int. Cl.[4] ..... G08G 1/12

[52] U.S. Cl. ..... 340/994; 340/539; 340/992

[58] Field of Search ..... 340/988, 989, 991-994, 340/996, 539; 364/436, 424; 455/49, 99

[56] References Cited

U.S. PATENT DOCUMENTS

| | | | |
|---|---|---|---|
| 2,429,607 | 10/1947 | Capen . | |
| 2,597,517 | 5/1952 | Noble | 340/994 |
| 3,101,394 | 8/1963 | Quinn . | |
| 3,105,119 | 9/1963 | Cory, Jr. et al. . | |
| 3,145,380 | 8/1964 | Currie . | |
| 3,268,862 | 8/1966 | Pettitt . | |
| 3,270,338 | 8/1966 | Watters . | |
| 3,383,595 | 5/1968 | Obata . | |
| 3,389,391 | 6/1968 | Keeler et al. . | |
| 3,530,434 | 9/1970 | Stites et al. | 340/989 |
| 3,568,161 | 3/1971 | Knickel | 340/993 |
| 3,660,762 | 5/1972 | Smith . | |
| 3,839,717 | 10/1974 | Paul . | |
| 3,886,515 | 5/1975 | Cottin et al. | 340/994 |
| 4,220,946 | 9/1980 | Henriot | 340/994 |
| 4,297,672 | 10/1981 | Fruchey et al. | 340/994 |
| 4,325,057 | 4/1982 | Bishop | 340/994 |
| 4,350,969 | 9/1982 | Greer | 340/994 |
| 4,713,661 | 12/1987 | Boone et al. | 340/991 |

FOREIGN PATENT DOCUMENTS

| | | | |
|---|---|---|---|
| 0219859 | 4/1987 | European Pat. Off. | 340/994 |
| 2399702 | 3/1979 | France | 340/994 |

*Primary Examiner*—Joseph A. Orsino
*Assistant Examiner*—Brent A. Swarthout
*Attorney, Agent, or Firm*—Buchanan Ingersoll; Gordon R. Harris

[57] ABSTRACT

Each vehicle of a transport system is provided with a short range transmitter which continuously transmits the vehicles route designation in digitally encoded form, preferably by short wave radio. Some or all stops are each provided with a short range receiver decoder and display means. All transmitters and receivers operate on the same frequency. The receiver stores codes for all routes with stops at the receiver location, matches encoded signals it receives with the stored codes and displays the matched designation.

1 Claim, 5 Drawing Sheets

SCROLLING SIGN

BUS #165 RICHLAND FASHION MALL

FIG. 6A

LIGHT PANEL WITH ADVERTISING SPACE

| | |
|---|---|
| ● | FIRST STREET |
| ○ | RICHLAND FASHION MALL |
| ● | LAKE AIR MALL |
| ● | AUSTIN AVE. |
| ○ | WASHINGTON AVE. |

...GIVE TO THE UNITED WAY.

FIG. 6B

ROUTE INDICATING SIGNALLING SYSTEMS FOR TRANSPORT VEHICLES

This invention relates to an apparatus for signaling the arrival of public or scheduled private transport, such as a bus, at a destination. It is more particularly concerned with apparatus for signalling by radio or otherwise from the moving vehicle of a route and designation of the vehicle. At the various stops along the vehicle route are positioned receivers which automatically pick up the transmission from the vehicle and display the vehicle route and designation.

BACKGROUND OF THE INVENTION

One of the deficiencies of public or scheduled private transport, particularly local transport, is that the vehicles are not always able to make their route stops at scheduled times. The passenger waiting for the vehicle at any stop usually has no foreknowledge of this discrepancy when it occurs. When a vehicle is delayed, particularly in a shopping area, passengers could not infrequently utilize their time more to their advantage than merely waiting at the bus terminal or stop. But unless they remain at the stop, they have no advance warning of the vehicle when it appears. The principal object of my invention is to overcome this undesirable situation by automatically operating apparatus.

THE PRIOR ART

In a railroad or bus station and in airline terminals boards or television screens generally list arrival and departure times or various routes. Those indications are sometimes corrected when schedules are not being met but those corrections are effected through two way wire or radio communication over conventional channels and are not automatically related to the travel of the vehicle itself. The signalling is usually analog.

SUMMARY OF THE INVENTION

My invention, although suitable for many applications, is particularly suited to local bus systems and will be described herein in that context.

My invention contemplates a short-range automated transmitter on each bus of a system and an automated receiver with display at some or all stops for each bus on its route. Transmitter and receiver are preferably short-range radio devices. All transmitters and receivers operate on the same carrier frequency. Each transmitter stores digitally encoded route numbers and their associated verbal designations and has switching means by which the driver can select the route number and its associated designation which identifies the route to which his bus is assigned. The selected route and identification is continually transmitted as a series of pulses modulated by frequency shift keying, amplitude shift keying or phase shift My invention contemplates receivers for the above-mentioned signals fixed at selected stops on each route or at all stops if desired. Each receiver includes a demodulator which retrieves the encoded information signal for its route from the signal when it is picked up by the receiver. Each receiver has storage means for the codes of all routes with stops at the receiver location and compares the encoded number it receives with the stored codes until it matches the received signal with one of those stored signals. The receiver also includes display means which display the route and designation supplied by the transmitter which corresponds to the matched code.

The range of the transmitter is made quite small, perhaps 50 feet or so, and the range of the receiver is made even smaller, perhaps 15 feet or so. Thus a receiver normally picks up signals from only one bus at a time and its display indicates only the nearest bus.

BRIEF DESCRIPTION OF THE DRAWINGS

FIGS. 6*a* and 6*b* are diagrammatic representations of display boards shown in FIG. 3.

DESCRIPTION OF PREFERRED EMBODIMENT

Figure 1:
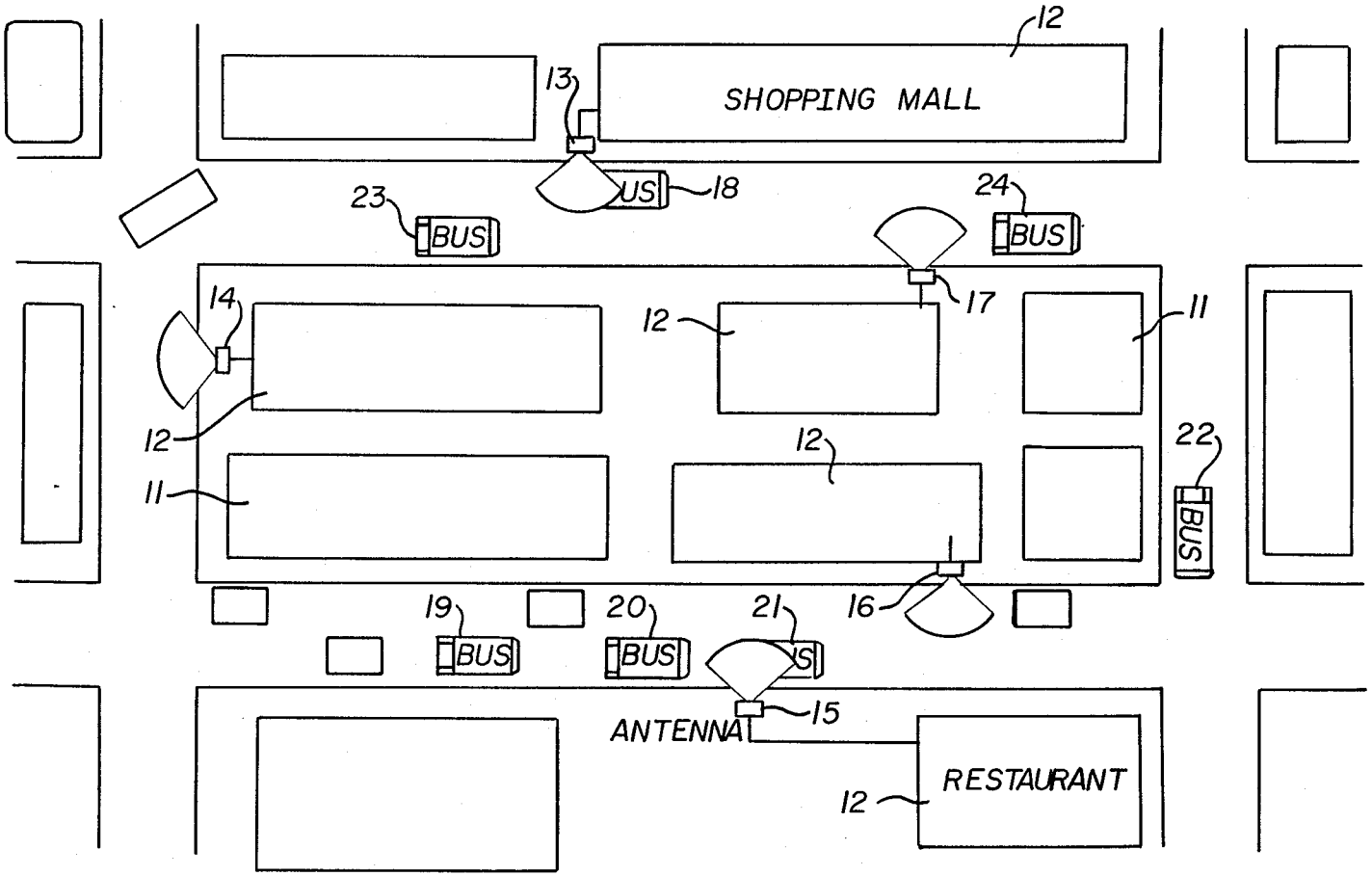
FIG. 1 is a plan of a city block served by buses showing the location of receivers of my invention.

The city block of FIG. 1 comprises various buildings 11 not individually identified and five buildings 12 each adjacent a bus stop. At each of those bus stops a radio receiver of my invention to be described hereinafter is fixed, those receivers being identified by numbers 13–17 respectively. The dotted area associated with each receiver in the figure indicates the zone of its effective reception. In the block, the buses 22, 23 and 24 are shown moving clockwise and four buses 18, 19, 20 and 21 are shown moving counterclockwise. The buses are all of different routes designated by route numbers and verbally by destination or otherwise. Each bus carries a radio transmitter of my invention to be described hereinafter. All transmitters and receivers operate continually on the same carrier frequency. The transmitters all have a transmission range at least equal to the receiving range of the receivers or somewhat greater.

The figure shows buses 19 and 20 approaching receiver 15 and bus 21 at that receiver. Assume that bus 21 is routed to stop at receiver 15. If bus 20 is also routed to stop at receiver 15 it will not be received until it is within the reception range of receiver 15. That receiver therefore will display only the route number and designation of bus 21. After bus 21 pulls away bus 20 will approach within the reception range of receiver 15 and that receiver will display the route number of bus 20, which may be different from that of bus 21. Assume bus 19 is *not* scheduled to stop at receiver 15. When bus 20 pulls away bus 19 will approach and receiver 15 will not recognize bus 19 nor display its route number and designation.

TRANSMITTER

Figure 2:
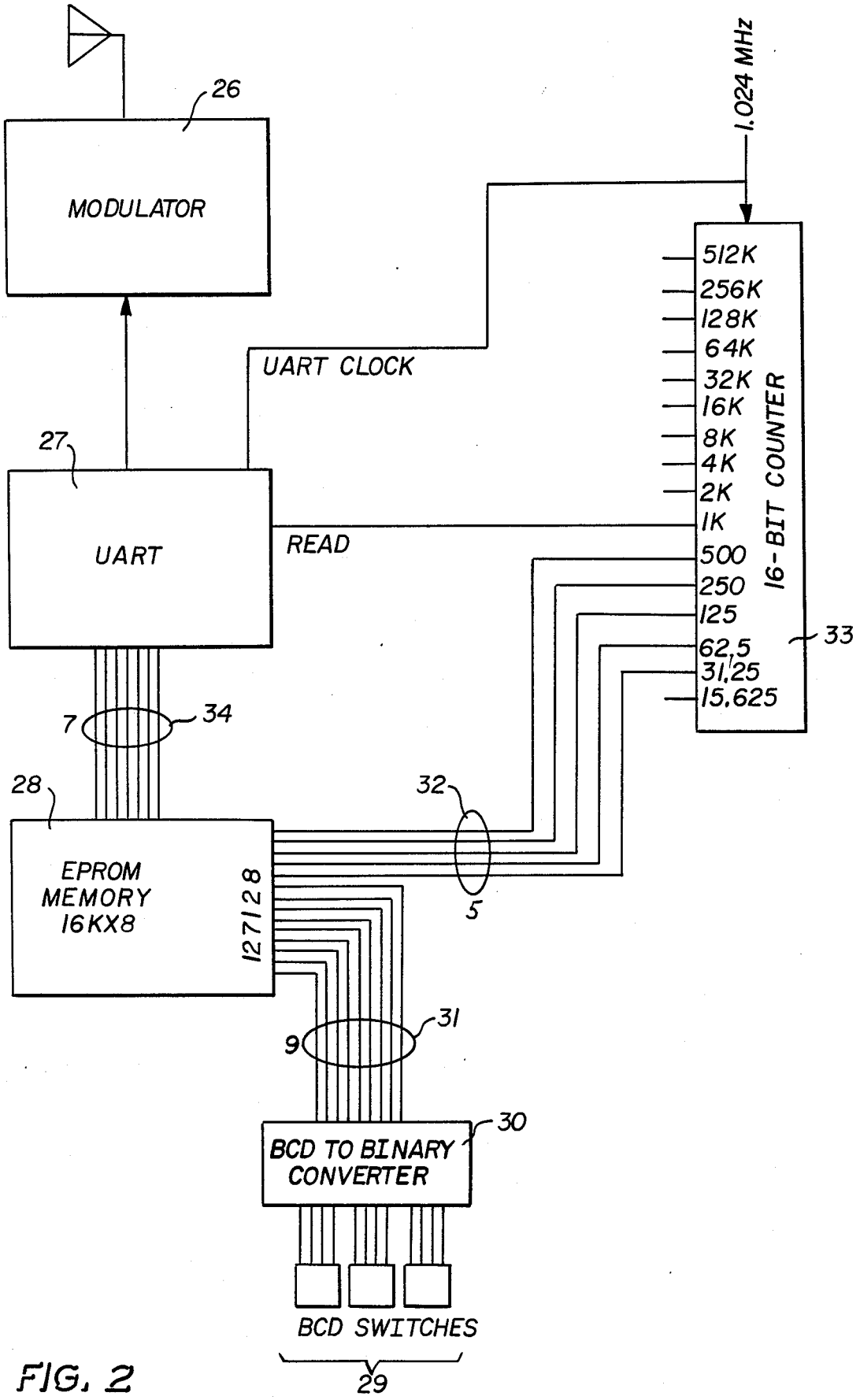
FIG. 2 is a block schematic of a transmitter of my invention.

A suitable transmitter is the universal asynchronus receiver-transmitter (UART) 27 and associated apparatus of FIG. 2 as identified in the parts table. As shown, the transmitter can store 512 route numbers and designations in a 16K×8 programmable read-only memory (PROM) or an erasable PROM (EPROM) 28. Each route number and its designation are stored in the EPROM as sequential ASCII characters in groups of 32 characters each. Three ten-position BCD switches 29 converted to binary equivalents in BCD binary converter 30 compose through lines 31 the nine most significant bits of the EPROM 28 address. The lower five bits of the 14 bit address are circulated through lines 32 to the output of 16 bit counter 33. Those five bits cycle through the 32 characters determined by the upper nine bits. The eight bit output of the EPROM 28 is parallel loaded through lines 34 into UART 27. The UART is set for RS-232-C transmission at 9600 baud with seven bit data, one start bit, one stop bit, and no parity bit. The UART 27 loads parallel data at the rate of one KHZ. The serial signal which is a series of pulses is then fed into a modulator 26 with a band width of at least 9600 Hz. Modulator 26 is not described because it may modulate a carrier by frequency shift keying, amplitude shift keying or phase shift keying in conventional fashion. Alternatively, the UART output may be directly connected to an infra-red or invisible light transmitter. The term "carrier" when used herein indicates low, medium, high or ultra high frequency current and infrared or invisible light.

The data loaded into the EPROM 28 may be composed of any ASCII characters but must adhere to the pattern:

|STX| Route# (4 digits) |space| 25-character message |ETX|

STX and ETX are standard ASCII characters that mark the beginning and end of the coded message.

A standard loading device is used to load the PROM or EPROM 28. The PROM or EPROM may be changed at anytime to allow for route designation changes by either creating a new PROM or erasing and reprogramming the EPROM.

RECEIVER

Figure 3:
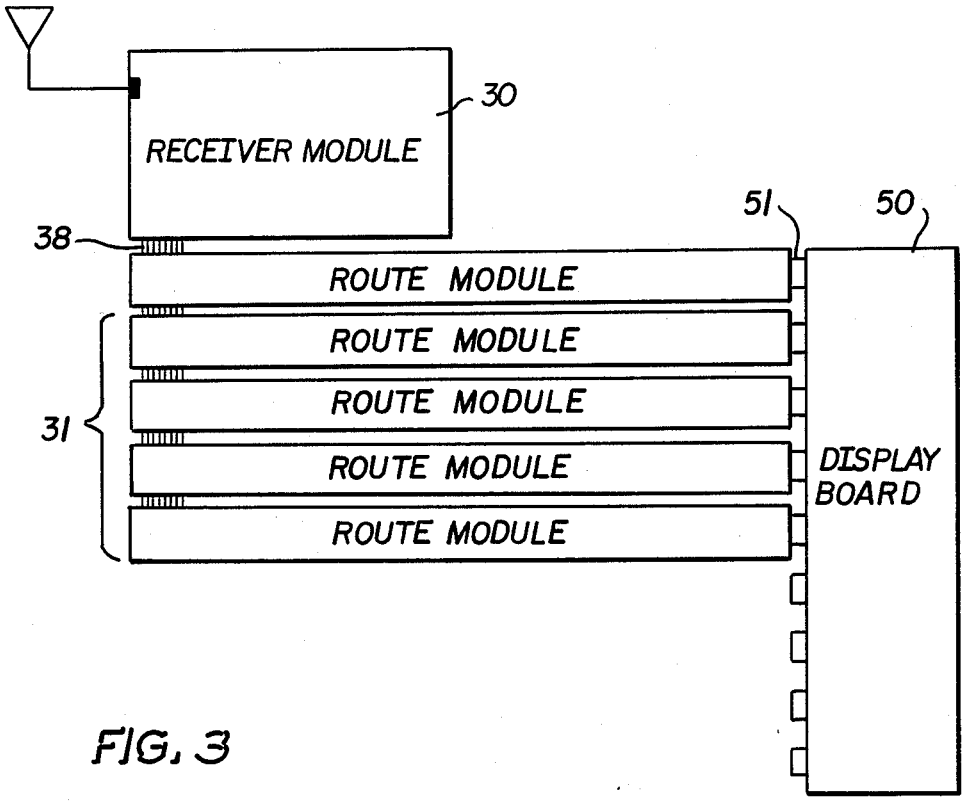
FIG. 3 is a block schematic of a receiver with route modules and display of my invention.
Figure 4:
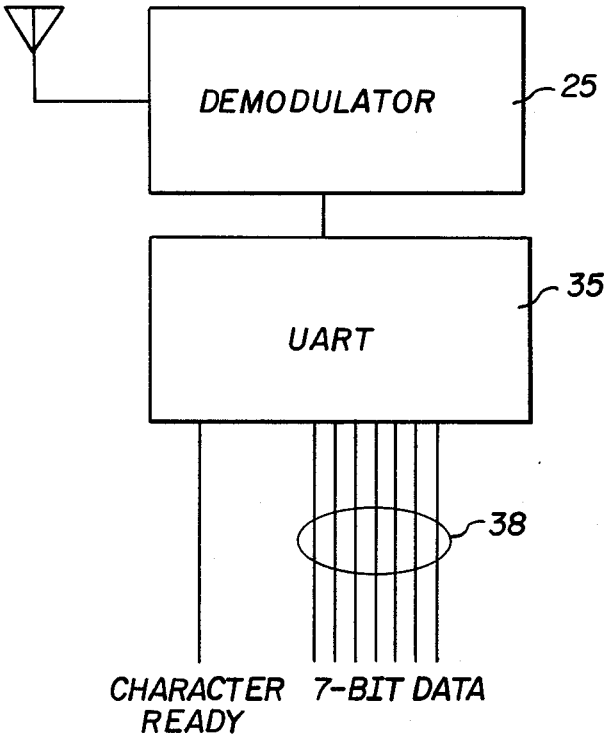
FIG. 4 is a block schematic or a portion of my transmitter.

The receiver shown in FIG. 3 comprises a receiver module 30, to be described hereinafter, one or more route modules 31, also to be described hereinafter, and a display board 50. The receiver module's principal components are a demodulator 25 and a UART 35, as are shown in FIG. 4. The demodulator receives the modulated signal emitted by modulator 26 of the transmitter and demodulates the modulated signal in conventional fashion to retrieve the RS-232-C format signal emitted by the transmitter UART 27. That signal is fed into receiver UART 35 which is compatable with UART 27 of the transmitter. The output of UART 35 is seven-bit parallel data which is the same format as that loaded into UART 27. As the characters are received they are put on common bus lines 38 which are shared by the route modules 31.

Figure 5:
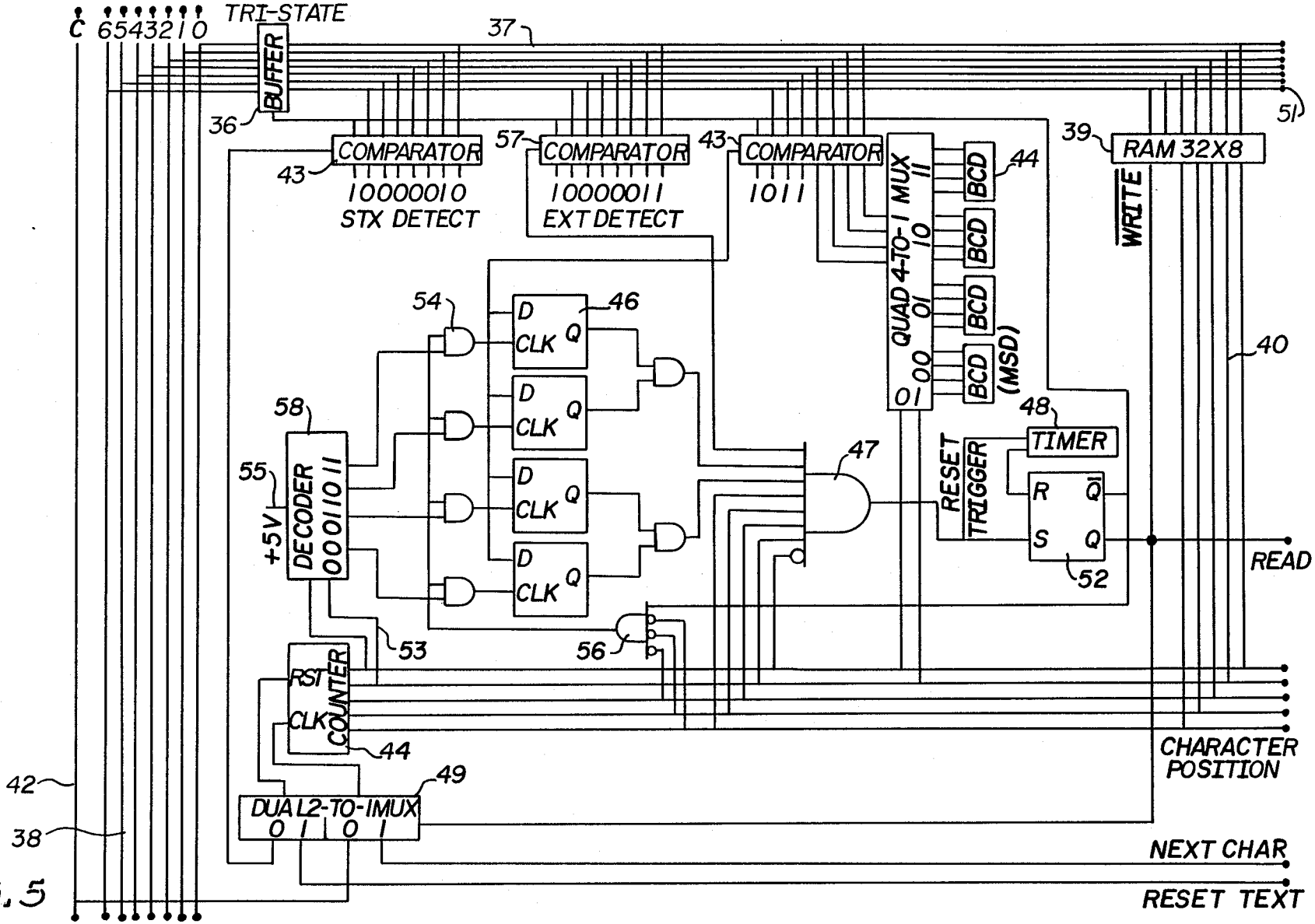
FIG. 5 is a circuit diagram of a route module shown in FIG. 3.

The number of route modules equals the number of bus routes which have stops at the location of a particular receiver. All route modules in a receiver are connected to receiver module 30 by common bus 38, also shown in FIG. 5. The common bus is connected to each individual route module through a tri-state buffer 36. Initially, buffer 36 is enabled and all route modules monitor the data appearing on the common bus 38. A random access memory 39 is also connected to buffer 36 by local bus 37 and stores the characters that are put on common bus 38. Address lines 40 for the memory 39 are controlled by a five bit counter 41 which is incremented by the character ready line 42 from the main module. Whenever the ASCII "STX" appears on common bus 38, counter 41 is reset to zero. The next four characters (route numbers) are examined by a comparator 43 which compares the numbers received with the preset route number on the route module. The most significant digit (MSD) through the least significant digit (LSD) are checked and the result of each is stored in a "D" flip-flop 46. Each of the four flip-flops 46 verifies one of the four route identification digits. Decoder 58 is a 4 to 1 decoder which determines which of the four flip-flops is active. This it does in response to the signals from counter 41 over lines 53. Decoder 58 is also supplied with a +5 volt input 55 which is a binary 1. It checks a group of four digits only when they are the first four digits because of the "and" gate 56 whose output connects to "and" gates 54. As characters continue to arrive they are stored in RAM 39. When the last character, which appears when the counter is equal to 30 (or $11101_2$) arrives, it is checked to make sure it is an ASCII "ETX" character.

If the route number matches and the last character at comparator 57 is an "ETX" then the "and" gate 47 sets an SR flip-flop 52 to signify the reception of a valid route message.

At this point a "lock out" condition exists and results in the following:

First, the tri-state buffer 36 is disabled, so disconnecting local bus 37 from common bus 38.

Second, random access memory 39 is changed from the "write" to the "read" mode.

Third, electronic timer 48 is started.

Fourth, control of the counter increment and reset 49 is handed over to the display board 50.

Finally, a ready line is set to "1" signifying to display board 50 that a valid route/message was received.

Characters may now be transferred on local bus 37 from RAM 39 to display board 50 through data-out connections 51. The counter remains in the lock-out condition until timer 48 resets the SR flip-flop 52. That time may be from one to ten minutes depending on the needs of the particular location. When timer 48 resets flip-flop 52, the route module again monitors the common bus 38.

All route modules 31 function in the same way except that they have different valid route numbers. My route modules and my valid route selection apparatus prevent a passing vehicle from displaying its message on a receiver display when it is not scheduled to stop at that receiver location.

DISPLAY BOARDS

Two forms of display board are illustrated in FIG. 6*a* and 6*b*. The scrolling character display board 6*a* can access the 30 characters stored in an "active" (lock-out condition) route module and scroll a message on the display. When no route modules are active the display is blank and advertising space thereon could be sold. The message could be flashed on the display to distinguish it from the advertising.

The light board display of FIG. 6*b* is somewhat less expensive and uses the ready signal from the route module to turn on one of the lights on the board. A slide-in sign containing the bus route number and destination or other designation could be inserted opposite each light.

My apparatus may also be used to monitor buses as they follow their routes. As my apparatus uses well-known serial transmission standards a computer may be connected at any receiving station to monitor, read and analyze the arrival of vehicles provided with my transmitters.

PARTS TABLE

| | ITEM | MFGR PART NUMBER | MFG |
|---|---|---|---|
| 27 | Universal asynchronous receiver transmitter (UART) | IM6402 | Intersil |
| 36 | Tri-state buffer | 71LS97 | Texas Instr |
| 43 | Comparator | CD4063 | RCA |
| 44 | Hex to BCD | 7442 | Texas Instr |
| 47 | And gate | 7408 | Texas Instr |
| 48 | Timer | NE555 | Texas Instr |
| 52 | SR flip flop | 7400 | Texas Instr |
| 46 | D flip flop | 74174 | Texas Instr |
| 58 | 1 to 4 decoder | 74153 | Texas Instr |
| 41 | 0-16 counter | 7493 | Texas Instr |
| 49 | Mux | 74157 | Texas Instr |

I claim:

1. In apparatus for short range signaling from signal transmitters carried by moving vehicles of a transport system to receivers for said signals fixed at stops for said vehicles over designated routes, the improvement comprising storage means at each transmitter for digitally encoded designations of said routes, selecting means at each transmitter for selecting a desired designation from said storage means, means at each transmitter for converting said selected designation into an output comprising a repeated succession of pulses indicative of the selected designation route only, means at each receiver for receiving a modulated carrier and retrieving therefrom digitally said repeated succession of pulses, storage means at each receiver for said digitally encoded designations of routes, means at each receiver for comparing said retrieved succession of pulses with said stored digitally encoded designations of routes and for matching said retrieved succession of pulses with a single predetermined digitally encoded designation of route, and means at each receiver for displaying said matched designation, the short range of each transmitter being not substantially greater than the length of said moving vehicle and the range of each receiver being less than the short range of each transmitter, whereby each receiver receives successively but not simultaneously signals from a succession of said vehicles approaching each respective receiver one after another, wherein all transmitters and receivers operate on the same frequency, and each receiver only receives signals from a single transmitter at a time, said single transmitter being located on a vehicle within the range of the respective receiver, wherein only one matched designation is displayed at a time at each displaying means.

* * * * *